United States Patent [19]

Yasutomi et al.

[11] Patent Number: 4,977,799

[45] Date of Patent: Dec. 18, 1990

[54] CLAMPING TOOL FOR STUD BOLT

[76] Inventors: Sueharu Yasutomi, 4-11, Uehonmachinishi 2-chome, Chuo-ku, Osaka; Morimasa Taniguchi, 8-3, Oimazato 3-chome, Higashinari-ku, Osaka, both of Japan

[21] Appl. No.: 413,386

[22] Filed: Sep. 27, 1989

[30] Foreign Application Priority Data

Sep. 28, 1988 [JP] Japan ..... 63-245704

[51] Int. Cl.[5] ..... B25B 13/50

[52] U.S. Cl. ..... 81/53.2

[58] Field of Search ..... 81/53.2

[56] References Cited

U.S. PATENT DOCUMENTS

| | | | |
|---|---|---|---|
| 1,438,269 | 12/1922 | Sehrt | 81/53.2 |
| 1,536,320 | 5/1925 | Ziegler | 81/53.2 |
| 2,795,159 | 6/1957 | Sipe | 81/53.2 |
| 3,368,430 | 2/1968 | Levering | 81/53.2 |

FOREIGN PATENT DOCUMENTS

| | | | |
|---|---|---|---|
| 1045927 | 12/1958 | Fed. Rep. of Germany | 81/53.2 |
| 979657 | 1/1949 | France | 81/53.2 |
| 143984 | 6/1920 | United Kingdom | 81/53.2 |

*Primary Examiner*—James G. Smith

*Attorney, Agent, or Firm*—Wenderoth, Lind & Ponack

[57] ABSTRACT

A clamping tool for use with a stud bolt includes a tubular body formed on its inner periphery with first female threads adapted to engage a stud bolt and second female threads. A drive shaft is provided on its bottom end with a threaded shank adapted to engage the second female threads. A torque transmission mechanism is provided between the tubular body and the drive shaft so that they will come into engagement with each other when the drive shaft is turned in a direction to tighten the stud bolt and get out of engagement when the drive shaft is turned in the opposite direction. Thus the torque necessary to loosen the clamping tool to detach it from the stud bolt tightened in position is much smaller than the torque necessary to tighten the stud bolt.

7 Claims, 4 Drawing Sheets

CLAMPING TOOL FOR STUD BOLT

BACKGROUND OF THE INVENTION

The present invention relates to a clamping tool for a stud bolt.

FIG. 12 illustrates one prior art method for screwing a stud bolt in which a box nut 60 is screwed on top of a stud bolt B and a torque wrench is brought into engagement with the box nut 60 to turn it together with the stud bolt B. In another prior art method shown in FIG. 13, two nuts 61 and 62 are screwed on the stud bolt B and the nut 62 is turned to tighten the stud bolt B while keeping the other nut 61 from turning.

In either of the above two methods, it is necessary to impart a force substantially equal to the force required to tighten the stud bolt B to the box nut 60 or the nut 62 in order to loosen the box nut 60 or the nuts 61 and 62. Such work is naturally troublesome.

Further, in the latter prior art method, it is necessary to keep the nut 61 unrotatable by use of a spanner or the like when loosening the nut 62. If an electric tool or a pneumatic tool is used to loosen the nut 62, the operator's safety will be jeopardized.

SUMMARY OF THE INVENTION

It is an object of the present invention to provide a clamping tool for a stud bolt which obviates the above-said shortcomings and which can be readily removed from a stud bolt which has been tightened in position.

In accordance with the present invention, there is provided a clamping tool for a stud bolt, comprising a tubular body having an axial bore formed on a wall surface thereof with first female threads adapted to be brought into threaded engagement with a stud bolt and second female threads. A drive shaft is provided on one end thereof with a threaded shank adapted to be brought into threaded engagement with the second female threads, and a torque transmission means is provided between the drive shaft and the tubular body so that the drive shaft and the tubular body will come into engagement with each other when they are turned with respect to each other by a predetermined angle, thereby transmitting the turning torque applied to the drive shaft in such a direction as to tighten the stud bolt through both the threaded shank and the torque transmission means to the stud bolt.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENTS

Figure 1:
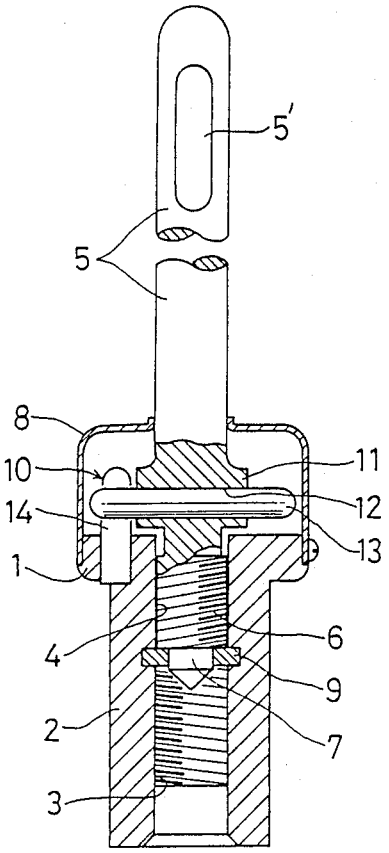
FIG. 1 is a vertical sectional front view of a first embodiment of the present invention.
Figure 2:
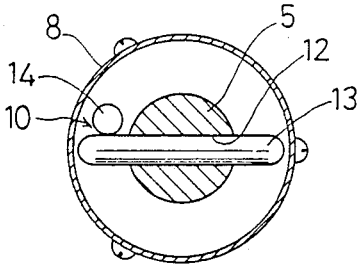
FIG. 2 is a cross-sectional plan view of the same.

FIGS. 1 and 2 show a first embodiment of the present invention, in which a clamping tool includes a tubular body 2 provided with a flange 1 and formed on its inner peripheral surface with first female threads 3 and second female threads 4 both extending axially. The first female threads 3 are adapted to be brought into engagement with a stud bolt.

The second female threads 4 are in threaded engagement with a threaded shank 6 provided on the bottom of a drive shaft 5. The threaded shank 6 is provided on its bottom end with a small-diameter shank 7 having a pointed tip. It may have a rounded tip instead.

A torque transmission mechanism 10 is provided between the tubular body 2 and the drive shaft 5 to transmit a turning torque imparted to the drive shaft 5 to the tubular body 2. It comprises a torque transmission pin 13 extending through a diametrical hole 12 formed in the drive shaft 5 at its lower portion having its outer periphery flanged as shown at 11, and an engaging pin 14 adapted to abut one of the protruding ends of the torque transmission pin 13 (FIG. 2).

Figure 7:
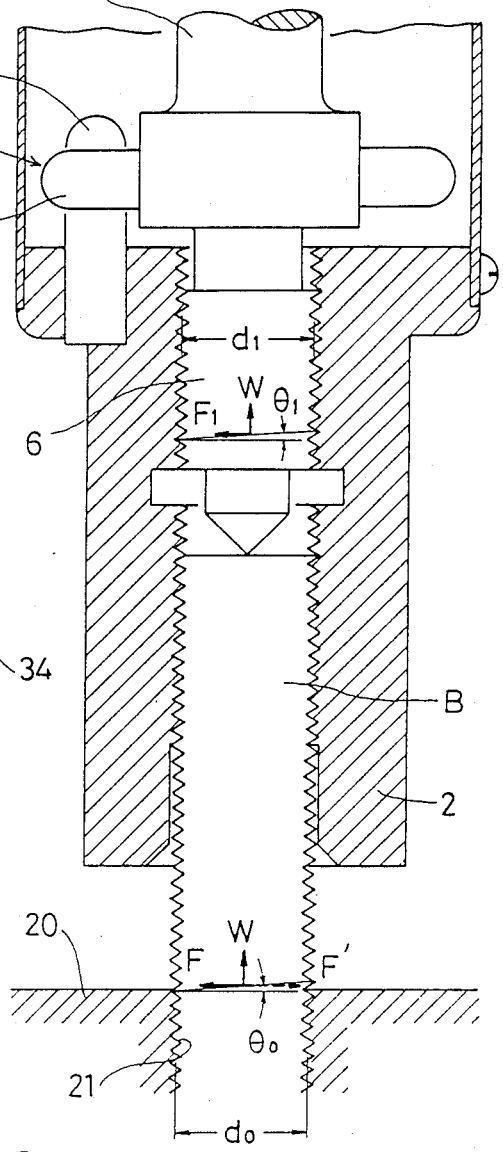
FIG. 7 is a partial sectional view of the first embodiment showing how it is used to tighten a stud bolt.

Now we shall describe, by use of some general formulas, the relationship among the forces which act when driving the stud bolt B into a member to be clamped 20 in the manner shown in FIG. 7. In the formulas, the frictional force between the top of the stud bolt B and the small-diameter shank 7 on the drive shaft 5 is ignored, because it acts on both of them equally. In FIG. 7, the force F necessary to turn the stud bolt B is given by the formula:

$$F = W \tan(\phi_0 + \theta_0) \quad (1),$$

while the force F′ necessary to loosen the bolt B is given by the formula:

$$F = W \tan(\phi_0 + \theta_0) \quad (2),$$

wherein $\theta_0$ represents the lead angle of the threads on the stud bolt B, $\phi_0$ represents the frictional angle and W represents the counterforce from the surface of a threaded hole 21.

The turning torque To necessary to turn the stud bolt B and the turning torque To′ necessary to loosen the stud bolt B are given by the formulas:

$$To = F \cdot \frac{do}{2} \quad (3)$$

$$To' = F' \cdot \frac{do}{2}, \quad (4)$$

wherein do is the mean diameter of the stud bolt B.

The following formulas are derived from the formulas (1) and (2):

$$To = \frac{W \cdot do}{2} \tan(\phi_0 + \theta_0) \quad (5)$$

$$To' = \frac{W \cdot do}{2} \tan(\phi_0 - \theta_0) \quad (6)$$

It will be apparent from the formula (5) that it is necessary to impart the turning torque To to the tubular body 2 in order to drive the stud bolt B into the member 20 with the bolt B in meshing engagement with the female threads 3 on the tubular body 2 while its head is in abutment with the small-diameter shank 7 on the threaded shank 6.

When the drive shaft 5 is turned, the turning torque on the drive shaft 5 will be transmitted to the tubular body 2 both through the torque transmission pin 13 and the engaging pin 14 and through the threaded shank 6 in threaded engagement with the second female threads 4. The turning torque T1 transmitted to the tubular body 2 through the threaded shank 6 is given by the formula:

$$T_1 = \frac{W \cdot d1}{2} \tan(\phi_1 + \theta_1) \quad (7)$$

wherein $\theta_1$ represents the lead angle of the threads on the threaded shank 6, $\phi_1$ represents the frictional angle, dl represents the mean diameter of the threaded shank 6 and W represents the counterforce transmitted from the threaded surface. The counterforce W is equal to the counterforce which acts on the stud bolt B. Thus the formula (7) is in principle the same as the formula (5).

In order for the turning torque T1 transmitted through the threaded shank 6 which satisfy the formula (7) to be kept smaller than the turning torque T0 necessary to tighten the stud bolt B, in other words, in order to satisfy the relational expression:

$$T_1 < To = \frac{W \cdot d1}{2} \tan(\phi_1 + \theta_1) < \frac{W \cdot do}{2} \tan(\phi_0 + \theta_0)$$

At least one of the mean diameter dl and the frictional angle of the threads on the threaded shank 6 has to be smaller than the mean diameter d0 and the frictional angle of the threads on the stud bolt B. Otherwise, the threads on the threaded shank 6 and those on the stud bolt B may be square threads and triangular threads, respectively.

In order to minimize the frictional angle $\phi_1$, the threads on the threaded shank 6 may be coated with a film of a solid lubricant such as molybdenum disulfide or may be treated with fluorine.

As shown in FIG. 1, a cover 8 is provided to surround the joint portion between the tubular body 2 and the drive shaft 5. Numeral 9 designates a dust-screening seal provided to prevent dust and any other foreign matter from getting into between the second female threads 4 on the tubular body 2 and the threads on the threaded shank 6.

To tighten the stud bolt B, it is first screwed into the tubular body 2 so as to engage its first female threads 3 until its head abuts the tip of the small-diameter shank 7, with the torque transmission pin 13 and the engaging pin 14 in abutment with each other as shown in FIG. 7. The stud bolt B is screwed into the threaded hole 21 in the member to be clamped 20 and the drive shaft 5 is turned in such a direction that the stud bolt B is driven into the threaded hole 21 in the member 20.

The drive shaft 5 may be turned by turning a rod inserted in a hole 5' formed diametrically through the drive shaft 5 or by use of a power tool.

As the drive shaft 5 is turned in the direction to tighten the stud bolt, its turning torque will be transmitted from the drive shaft 5 to the tubular body 2 through the torque transmission pin 13 and the engaging pin 14. The torque will be further transmitted to the stud bolt B, thus screwing it deep into the threaded hole 21.

Once the stud bolt B is screwed into such a depth that its end abuts the bottom of the threaded hole 21 in the member 20, the resistance to the turning force will increase, thus moving the tubular body 2 downwardly along the threaded surface on the stud bolt B, so that the small-diameter shank 7 is pressed against the head of the stud bolt B with an increasing force.

This will increase the contact force between the threads on the threaded shank 6 and the second female threads 4 on the tubular body 2, thus allowing the turning torque applied to the drive shaft 5 to be partially transmitted to the tubular body 2 through the threaded shank 6.

Though the turning torque thus transmitted to the tubular body 2 is not sufficient to tighten the stud bolt B, the turning torque applied to the drive shaft 5 is also transmitted to the tubular body through the torque transmission pin 13 and the engaging pin 14, thus making up for the shortage of torque necessary to tighten the bolt B.

The tubular body 2 will turn with the torque transmitted through the above two routes, thus tightening the stud bolt B firmly.

To loosen the clamping tool and remove it from the stud bolt B which has been tightened up, the drive shaft 5 is turned in the opposite direction. Then, the torque transmission pin 13 will separate from the engaging pin 14.

This means that the clamping tool can be loosened and removed only by applying to the drive shaft 5 a turning torque somewhat smaller than the torque transmitted to the tubular body 2 through the threaded shank 6 when tightening the bolt B. By the application of such a small torque, the threaded shaft 6 will get loose. As the threaded shank 6 turns through a predetermined angle, the torque transmission pin 13 will come into abutment with the engaging pin 14. Thereafter the tubular body 2 will be turned together with the drive shaft 5 so as to be removed from the stud bolt B.

It will be now apparent that the turning torque necessary to remove the clamping tool from the stud bolt is much smaller than the torque necessary to tighten the bolt.

Figure 3:
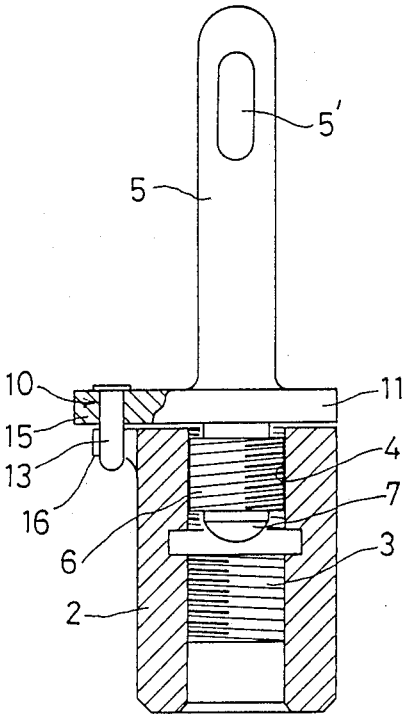
FIG. 3 is a vertical sectional front view of a second embodiment.
Figure 4:
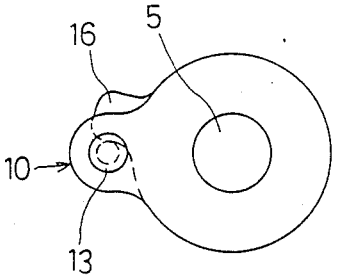
FIG. 4 is a plan view of the same.

FIGS. 3 and 4 show a second embodiment in which the torque transmission mechanism 10 comprises a torque transmission pin 13 extending through a projection 15 formed on the flange 11 provided around the drive shaft 5 and a protrusion 16 formed on the outer surface of the tubular body 2 and adapted to engage the pin 13. Otherwise, this embodiment is the same in structure and function as the first embodiment.

Figure 5:
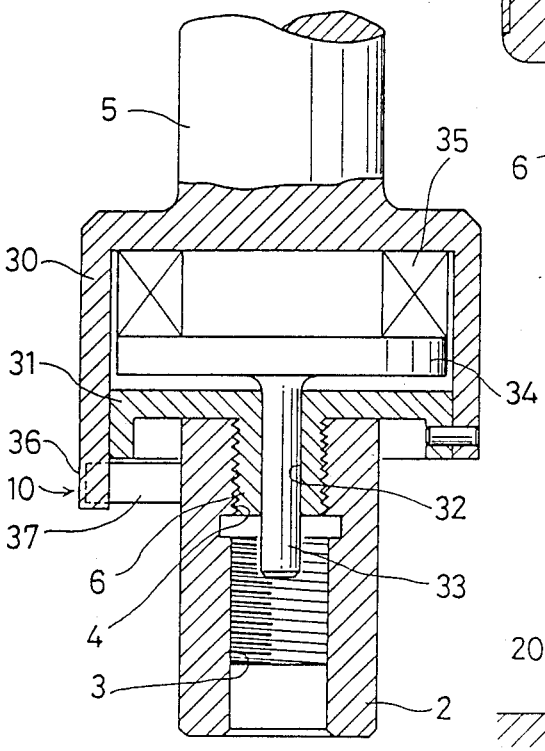
FIG. 5 is a vertical sectional front view of a third embodiment.
Figure 6:
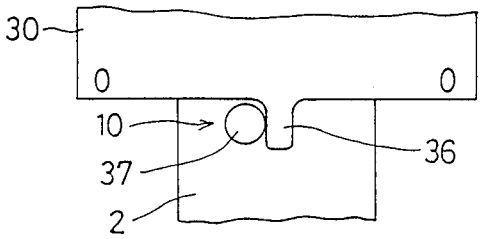
FIG. 6 is a side view of the torque transmission mechanism of the same.

FIGS. 5 and 6 show a third embodiment in which the drive shaft 5 is provided on its bottom with a housing 30. A bottom plate 31 is fixedly mounted in the housing 30 to close its bottom opening. It is provided on its bottom with a threaded shank 6' having its threads in threaded engagement with the second female threads 4 on the tubular body 2 and formed with a center hole 32. A shaft member 33 slidably extends through the center hole 32 and has a disk 34 secured to its end protruding into the housing 30. A thrust bearing 35 is mounted in the housing 30 to receive the counter-thrust which acts on the disk 34.

The housing 30 is provided on its bottom with a projection 36 whereas the tubular body 2 is provided on its outer surface with a pin 37 adapted to engage the projection 36 so that the turning torque applied to the drive shaft 5 is transmitted to the tubular body 2 through the projection 36 and the pin 37. Otherwise this embodiment is the same in structure and function as the first embodiment.

With the clamping tool in this embodiment, the stud bolt B cannot be screwed into the tubular body 2 beyond the point where its head engages the tip of the shaft member 33. The thrust bearing 35 serves to receive the counter-thrust which acts on the shaft member 33 when it engages the stud bolt. With this arrangement, the frictional force between the tip of the shaft member 33 and the head of the stud bolt B will have little influence in loosening the drive shaft 5 after tightening the stud bolt B. Thus the drive shaft 5 can be loosened with a smaller turning torque.

Figure 8:
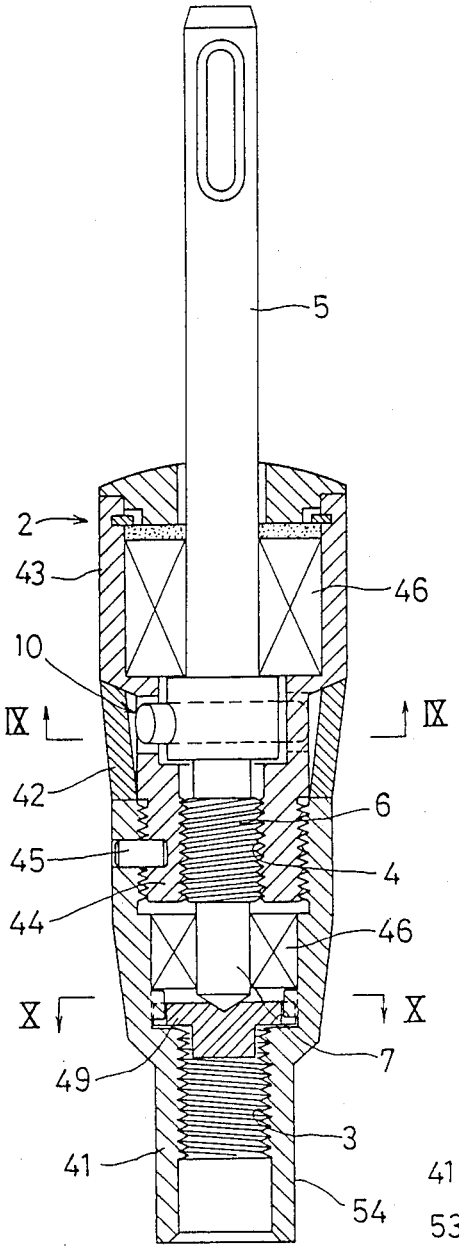
FIG. 8 is a vertical sectional front view of a fourth embodiment.
Figure 9:
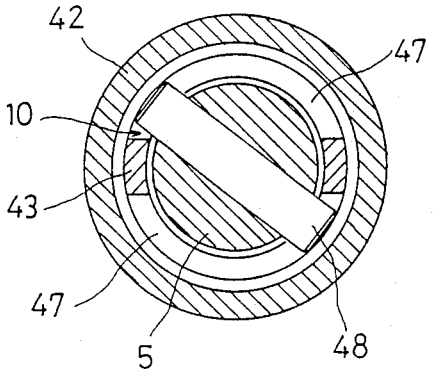
FIG. 9 is a sectional view taken along line IX—IX of FIG. 8.
Figure 10:
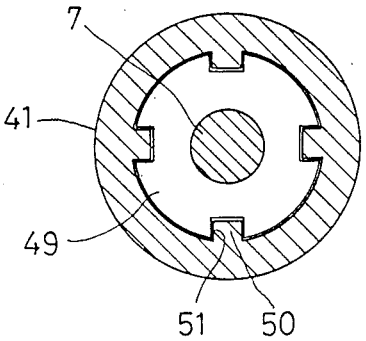
FIG. 10 is a sectional view taken along line X—X of FIG. 8.

FIGS. 8 to 10 show a fourth embodiment in which the tubular body 2 comprises a front ring 41, an intermediate ring 42 and a rear ring 43. The front ring 41 and the rear ring 43 are coupled together by having their respective threads 44 in engagement with each other and further by means of a pin 45 embedded in the joint portion.

The first female threads 3 and the second female threads 4 are formed on the inner peripheral surface of the front ring 41 and the rear ring 43, respectively.

The drive shaft 5 is rotatably supported by bearings 46 mounted in the front ring 41 and the rear ring 43. The torque transmission mechanism 10 for the transmission of torque from the drive shaft 5 to the tubular body 2 is provided between the drive shaft 5 and the rear ring 43.

As shown in FIG. 9, it comprises a pin 48 secured to the drive shaft 5 and pin holes 47 formed circumferentially in the rear ring 43 to receive the pin 48.

A friction member 49 is fitted in the front ring 41 below a small-diameter shank 7. As shown in FIG. 10, it is formed around its outer edge with axial grooves 51, whereas the front ring 41 is formed on its inner surface with axial ribs 50 received in the grooves 51, so that the friction member 4 will be axially slidable but prevented from turning with respect to the front ring 41.

By turning the drive shaft 5 in a direction to tighten the stud bolt with the tubular body 2 in threaded engagement with the stud bolt B, the friction member 49 will abut the head of the stud bolt B. By further turning the drive shaft 5 in the same direction with the stud bolt B engaged in the threaded hole in the member 20, the stud bolt B will be driven deep into the threaded hole.

The turning torque transmitted from the drive shaft 5 to the stud bolt B to tighten the bolt is converted into three components, i.e. the frictional force produced between the first female threads 3 and the threads on the stud bolt B, the frictional force produced between the head of the stud bolt B and the friction member 49 and the axial force which acts to press the stud bolt B against the friction member 49, thus tightening the tubular body 2 on the stud bolt B with a force proportional to the resistance acting on the stud bolt B.

In other words, the larger the frictional force between the head of the stud bolt B and the friction member 49, the smaller the axial force will be.

Since in the fourth embodiment, the turning torque is applied to the stud bolt B both through the first female threads 3 and through the friction member 49, the frictional force between the head of the stud bolt B and the friction member 49 will get larger than that between the head of the stud bolt B and the tip of the small-diameter shank 7 in the first embodiment. Thus the axial force, which acts to press the first female threads 3 and the threads on the stud bolt B against each other, will decrease correspondingly. The above axial force also acts to press the second female threads 4 and the threads on the threaded shank 6 against each other.

As a result of reduction in the axial force, the ratio of the turning torque transmitted to the tubular body 2 through the torque transmission mechanism 10 to the turning torque transmitted to the tubular body 2 through the threaded shank 6 will be larger than that in the first embodiment. In other words, the turning torque transmitted to the tubular body 2 through the threaded shank will be smaller than that in the first embodiment. This means that the clamping tool can be removed from the stud bolt with a smaller turning torque.

Also, if the frictional resistance between the friction member 49 and the small-diameter shank 7 is smaller than that between the friction member 49 and the stud bolt B, the clamping tool can be removed from the stud bolt B with a still smaller turning torque.

Figure 11:
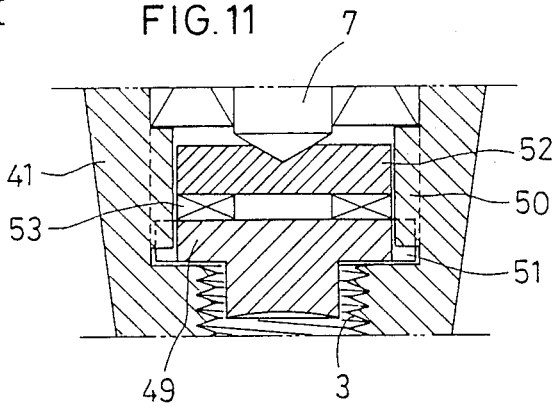
FIG. 11 is a sectional view of a means for reducing the resistance to rotation of a drive shaft.
Figure 12:
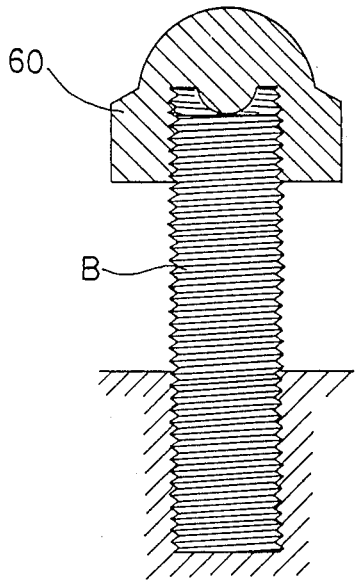
FIGS. 12 and 13 are sectional views of prior art clamping tools.
Figure 13:
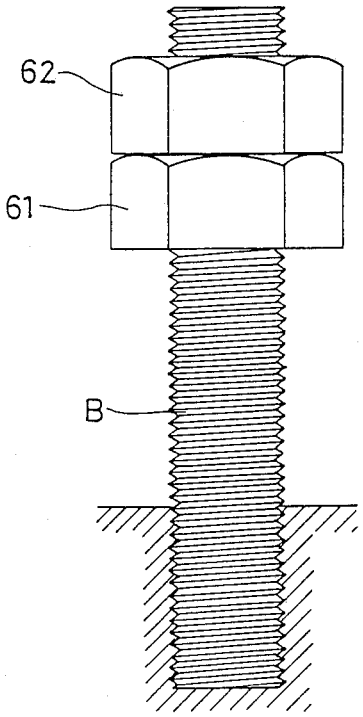

As shown in FIG. 11, thrust rollers 53 and a spacer 52 supported on the thrust roller 53 may be mounted between the small-diameter shank 7 and the friction member 49 to reduce the rotational resistance between the friction member 49 and the small-diameter shank 7 and thus to achieve the abovementioned purpose.

In the embodiment shown in FIG. 8, the tubular body 2 is formed on its outer periphery at its end with a wrench engaging portion 54. A wrench such as a spanner is adapted to be engaged therearound to turn the clamping tool together with the stud bolt and thus to pull the stud bolt out of the clamping member 20. Such a wrench engaging portion 54 may be formed on the tubular body 2 in the other embodiments.

To pull out the stud bolt B tightened in position by use of the clamping tool formed with the wrench engaging portion 54, the drive shaft 5 is turned in a direction to loosen the bolt B until the pin 48 abuts the wall of the pin holes 47. The tubular body 2 is then screwed and tightened on the stud bolt B to such an extent that the friction member 49 is pressed against the head of the stud bolt B but the stud bolt B is kept from turning in tightening direction.

Next the drive shaft 5 is turned in the same direction, i.e. the direction to tighten the bolt B within such a range that the pin 48 is out of contact with the wall of the pin holes 47, so that the first threads 3 on the tubular body 2 and the threads on the stud bolt B will press against each other with an axial force larger than that necessary to tighten the stud bolt B. The tubular body 2 and the stud bolt B are tightened together with this axial force.

The tubular body 2 thus tightened on the stud bolt B is turned by a wrench engaged on the engaging portion 54 in such a direction as to loosen the bolt B. The bolt B will be turned together with the tubular body 2. After pulling out the stud bolt B, the drive shaft 5 is turned in the loosening direction to detach the clamping tool from the stud bolt B.

What is claimed is:

1. A clamping tool for a stud bolt, comprising:

a tubular body having an axial bore therethrough, said axial bore having a wall surface having first female threads threadedly engaging a stud bolt and second female threads, said second female threads having a smaller mean diameter than said first female threads;

a drive shaft having a threaded shank on one end thereof for threadedly engaging said second female threads; and a torque transmission means between said drive shaft and said tubular body for engaging said drive shaft with said tubular body when said drive shaft and said tubular body are turned relative to each other by a predetermined amount of angular rotation.

2. The clamping tool as set forth in claim 1, wherein:

said threaded shank has a friction member adjacent to a bottom end thereof for engagement with a stud bolt, said friction member being mounted in said tubular body for axial sliding movement therein while being held rotationally fixed relative to said tubular body, and said bottom end of said threaded shank having a convex end face, said convex end facing having one of a conical and a semi-spherical shape.

3. The clamping tool as set forth in claim 2, wherein:

a thrust roller is disposed between said friction member and said threaded shank, and a spacer is disposed between said thrust roller and said threaded shank.

4. The clamping tool as set forth in claim 2, wherein:

said friction member has grooves therein, and said tubular body has axially extending ribs therein, said grooves mating with said ribs.

5. The clamping tool as set forth in claim 1, wherein:

said torque transmission means comprises a pin secured to said drive shaft and pin holes in said tubular body to be engaged by said pin.

6. A clamping tool for a stud bolt, comprising:

a tubular body having an axial bore therethrough, said axial bore having a wall surface having first female threads threadedly engaging a stud bolt and second female threads, said second female threads having a smaller mean diameter than said first female threads;

a drive shaft having a threaded shank on one end thereof for threadedly engaging said second female threads; and a torque transmission means between said drive shaft and said tubular body for engaging said drive shaft with said tubular body when said drive shaft and said tubular body are turned relative to each other by a predetermined amount of angular rotation;

wherein said threaded shank has a friction member adjacent to a bottom end thereof for engagement with a stud bolt, said friction member being mounted in said tubular body for axial sliding movement therein while being held rotationally fixed relative to said tubular body, and said bottom end of said threaded shank having a convex end face, said convex end facing having one of a conical and a semi-spherical shape.

7. The clamping tool as set forth in claim 6, wherein:

bearing means are disposed in said tubular body for rotatably bearing said drive shaft in said tubular body.

* * * * *